US005125435A

United States Patent [19]

Froment

[11] Patent Number: 5,125,435

[45] Date of Patent: Jun. 30, 1992

[54] ELECTRO-MAGNETIC CASSETTE UNIT FOR CONTROLLING DOBBIES

[75] Inventor: Jean-Paul Froment, Doussard, France

[73] Assignee: S.A. Des Etablissements Staubli (France), Faverges, France

[21] Appl. No.: 707,084

[22] Filed: May 29, 1991

[30] Foreign Application Priority Data

May 31, 1990 [FR] France ..... 90 07048

[51] Int. Cl.[5] ..... D03C 1/00

[52] U.S. Cl. ..... 139/455; 139/66 R; 335/219

[58] Field of Search ..... 139/455, 66 R; 66/219; 335/219, 229, 232, 230, 132

[56] References Cited

U.S. PATENT DOCUMENTS 3,810,368 5/1974 Wade et al. ..... 66/219 X
4,461,325 7/1984 Palau et al. ..... 139/66 R X
4,480,664 11/1984 Höhne et al. ..... 139/455 X
4,609,897 9/1986 De Koster et al. ..... 335/229 X

FOREIGN PATENT DOCUMENTS 2188335 9/1987 United Kingdom ..... 66/219

*Primary Examiner*—Andrew M. Falik
*Attorney, Agent, or Firm*—Dowell & Dowell

[57] ABSTRACT

An electro-magnetic unit for controlling the needles associated with the dobbies and other weaving mechanisms of a loom which includes a series of cassettes each containing electro-magnets for attracting blades associated with springs and stops to thereby define two stable positions for controlling the reciprocal movement of the needles and wherein the needles reciprocate through calibrated holes in a lower boss centered in an opening in the bottom of a box in which the cassettes are mounted.

7 Claims, 3 Drawing Sheets

ELECTRO-MAGNETIC CASSETTE UNIT FOR CONTROLLING DOBBIES

BACKGROUND OF THE INVENTION

1. FIELD OF THE INVENTION

The present invention relates to dobbies and other weaving mechanisms used for forming the shed in weaving looms, and more particularly to the control of these mechanisms by electro-magnetic means.

2. HISTORY OF THE RELATED ART

It is known that, in order to simplify the construction of dobbies, it has been proposed to replace the conventional reading apparatus employing punched paper, punched cards or pegged cylinder, by electromagnetic systems comprising two series of electromagnets placed under the control of a memory containing the weaving program corresponding to the weave desired for the fabric being produced on the loom. One of these series of electro-magnets corresponds to normal operation, the other to reverse operation or "unweaving". Each of them contains a number of electro-magnets equal to that of the independent actuation devices of the dobby or other mechanism, i.e. to the number of the heddle frames mounted on loom.

In the known constructions, each electro-magnet comprises a coil for attracting, against elastic return means, a pivoting blade of which the free end is adapted, in one of the two positions of operation, to form a stop for a needle displaced reciprocally along its axis. The needle cooperates with a device equipped with pushers and knives which reciprocate in order to effect control of an actuation lever of the dobby.

It will be readily appreciated that such a structure involves a complex assembly which, if it is desired to obtain faultless operation at the high speeds of weaving which are now adopted, must necessarily be very precise since any error in positioning necessarily creates a risk of defective functioning.

In practice, in order to compensate for the imprecisions resulting from the complexity of construction, the clearance of the blades or other mobile armatures is increased, which is detrimen-mobile to performance and requires more electrical power, causing overheating and leading to a higher cost.

It is an object of the present invention to overcome these drawbacks by providing an electro-magnetic control unit which presents a simplified structure ensuring fault-free operation.

SUMMARY OF THE INVENTION

The present invention relates to an electro-magnetic unit for controlling dobbies and other weaving mechanisms, of the type comprising at least one series of electro-magnets for controlling the movable needles of the control device employing pushers and knives, which effects displacement of the actuation levers of the mechanism. Each of the electro-magnets comprising a coil provided with a core for attracting a blade of which the shank is adapted to form a stop for one of the needles. The electro-magnets are mounted inside a series of flat cassettes stop for one of the said needles. The electro-magnets are mounted inside a series of flat cassettes which are maintained side by side in a box. Each of the cassettes includes in addition to the inner stops adapted to limit the displacement of the shank of the corresponding blade, and thereby define two stable positions for the blade at least one calibrated hole adapted to be traversed by the corresponding needle.

It will be readily appreciated that, in such a structure, each of the cassettes integrates its own guiding means and members for positioning its constituent elements, so that any risk of defective positioning with respect to the elements of the dobby is avoided.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
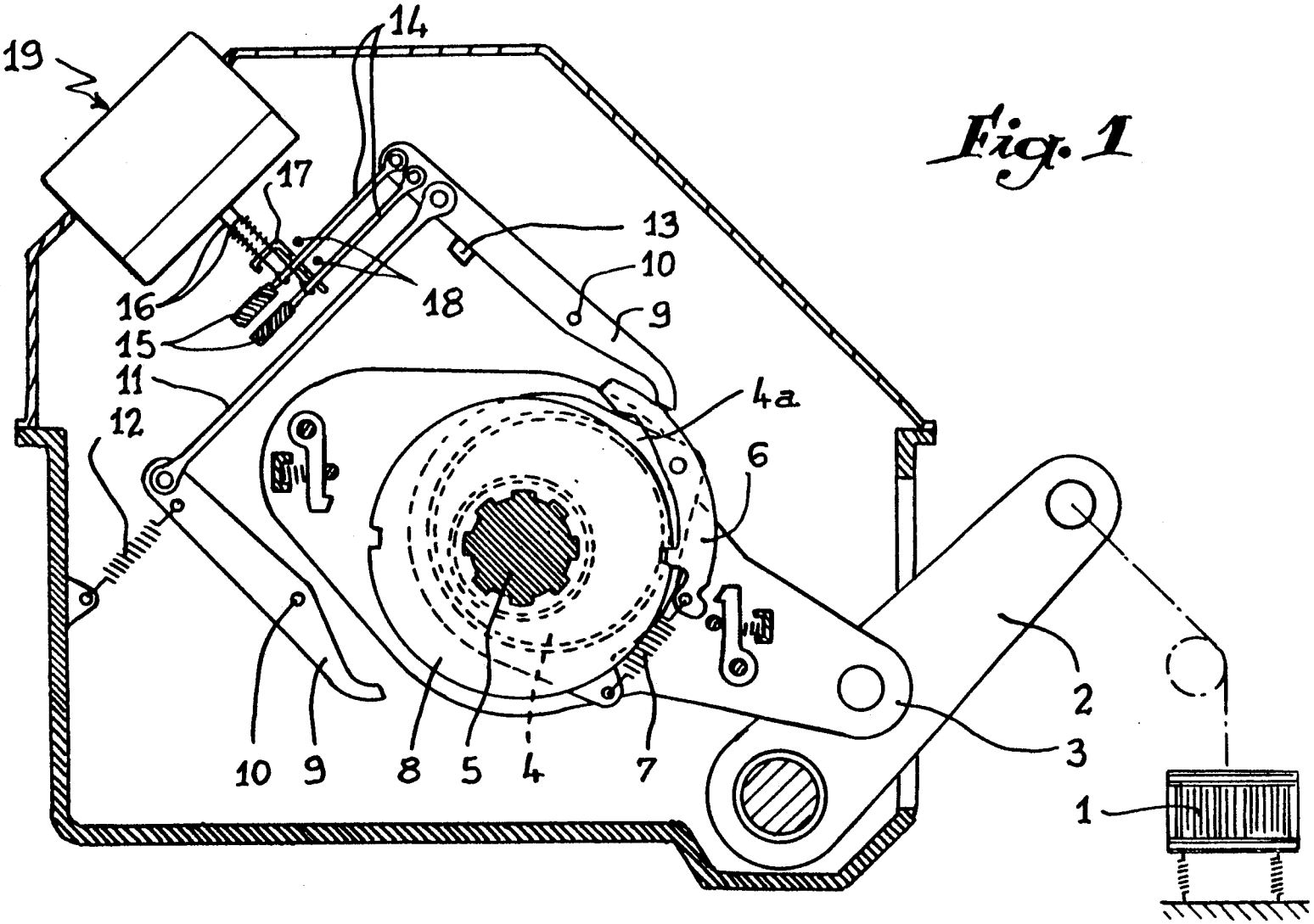
FIG. 1 is a transverse section illustrating schematically the installation of an electro-magnetic control unit according to the invention in a weaving dobby of the rotating type.

Referring now to the drawings, the rotating dobby, of the negative type, schematically illustrated in FIG. 1, is of a known construction and comprises, for moving each of the heddle frames 1, a swinging suspension lever 2 which is coupled to a connecting rod 3 with which are associated, on the one hand, an eccentric 4 mounted idly on a principal shaft 5 and moved by intermittent rotation, and on the other hand, a coupling hook 6 pivotally carried on a plate **4*a* secured with the eccentric. A spring 7 tends to engage the and of each hook 6 in one or the other of the two opposite notches of a driver 8 fitted on the shaft 5, consequently ensuring rotation of the eccentric 4 and control of the connecting rod 3**.

For actuating hook 6 against the action of spring 7, there are provided two levers 9 articulated at 10 on the frame of the dobby and coupled to each other by a rod 11. A spring 12 is fastened to one of the levers 9 and tends to urge the opposite lever against a fixed stop 13. Two parallel pushers 14 act on lever 9, with, two knives 15 are actuated by a lateral reciprocating movement in order to tend to urge the pushers axially when they are in alignment with the knives.

Lateral actuation of the pushers 14 is effected with the aid of two transverse needles 16 guided in a fixed separator 17 and associated with a movable leveller 18. Elastic means, in the form of a spring associated with each needle, tend to push the latter upwardly so that it can receive the control of the electro-magnetic unit 19 containing the weaving program, which unit forms the subject matter of the present invention.

Figure 2:
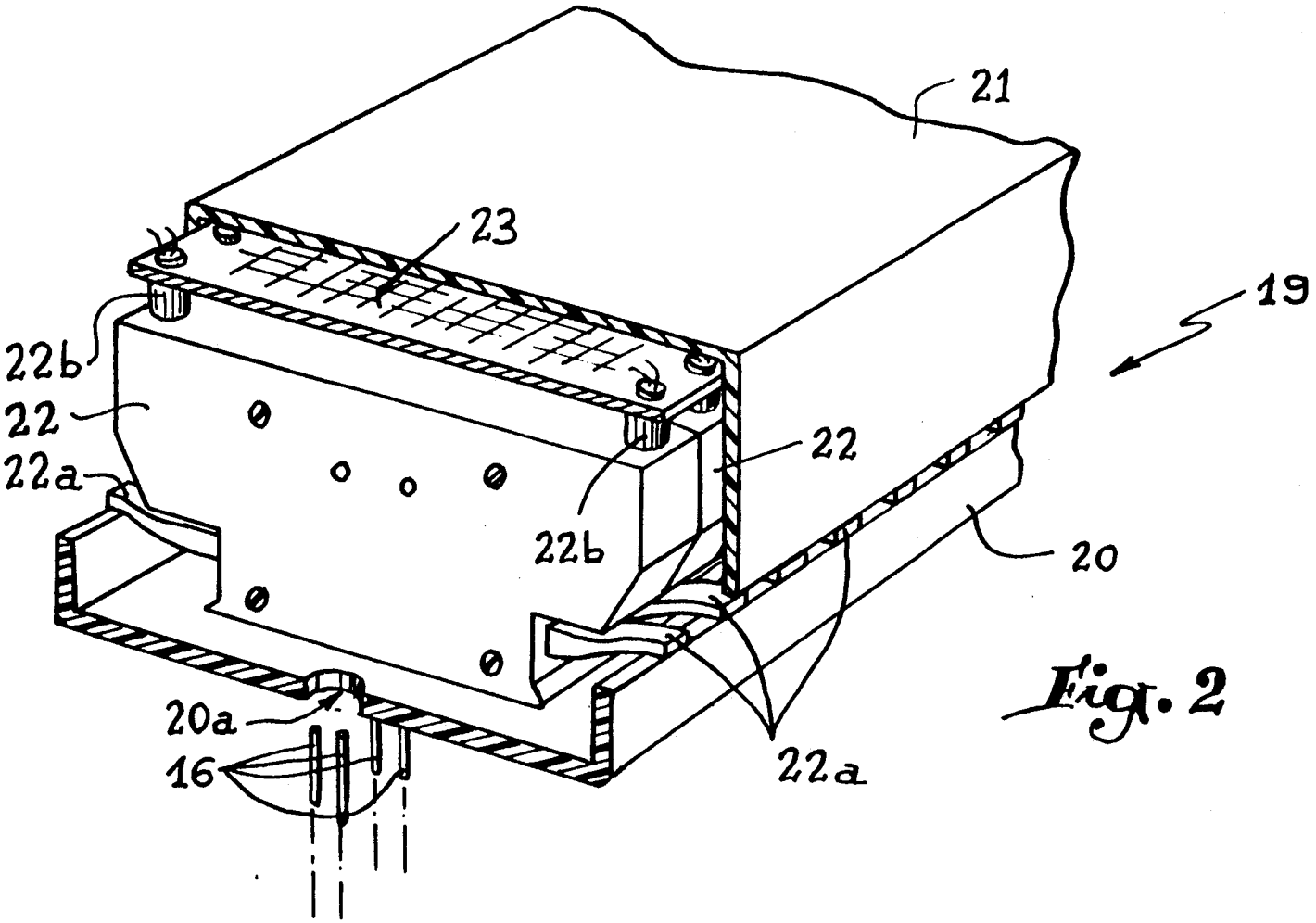
FIG. 2 is a perspective view, on a larger scale, of the control unit in transverse section.

As shown in FIG. 2, this unit 10 is in the form of a box including a lower housing 20 and a removable cover 21, assembled on each other in any appropriate manner, for example with the aid of screws (not shown). Inside this box 20–21 are arranged, side by side, a series of cassettes 22 of which the number corresponds, in fact, to that of the heddle frames 1 actuated by the dobby in question. Each cassette 22, is made by assembling two symmetrical halves of molded plastic material and includes two lugs **22*a* which are sectioned and dimensioned to be gripped between the opposite edges of the housing 20 and cover 21 when the latter are assembled, ensuring, by their elastic deformability, the application of the bottom of each cassette 22** against the bottom of the housing, without any other member.

Opposite this bottom, each cassette 22 is provided with two upper bosses 22*b* on which is clipped the printed circuit 23 which allows the electro-magnets to be electrically supplied, as a function of the weaving program incorporated in an electronic memory associated with the circuit 23, all this in known manner.

Inside each cassette 22 are two housings for two coils 24 (cf. FIG. 3), of which each is disposed around a metal core 24*a*. With each coil 24 is associated a blade 25 mounted to pivot on a fixed pin 26 secured to the cassette 22. The cassette also comprises a central stop 27 on either side of which are disposed two lateral stops 28 for limiting the angular displacement of the thin shank 25*a* of each tilting blade 25. It should be observed that each blade is permanently subjected to the action of a spring 29 abutting against a recessed component 30 in the cassette 22.

Figure 3:
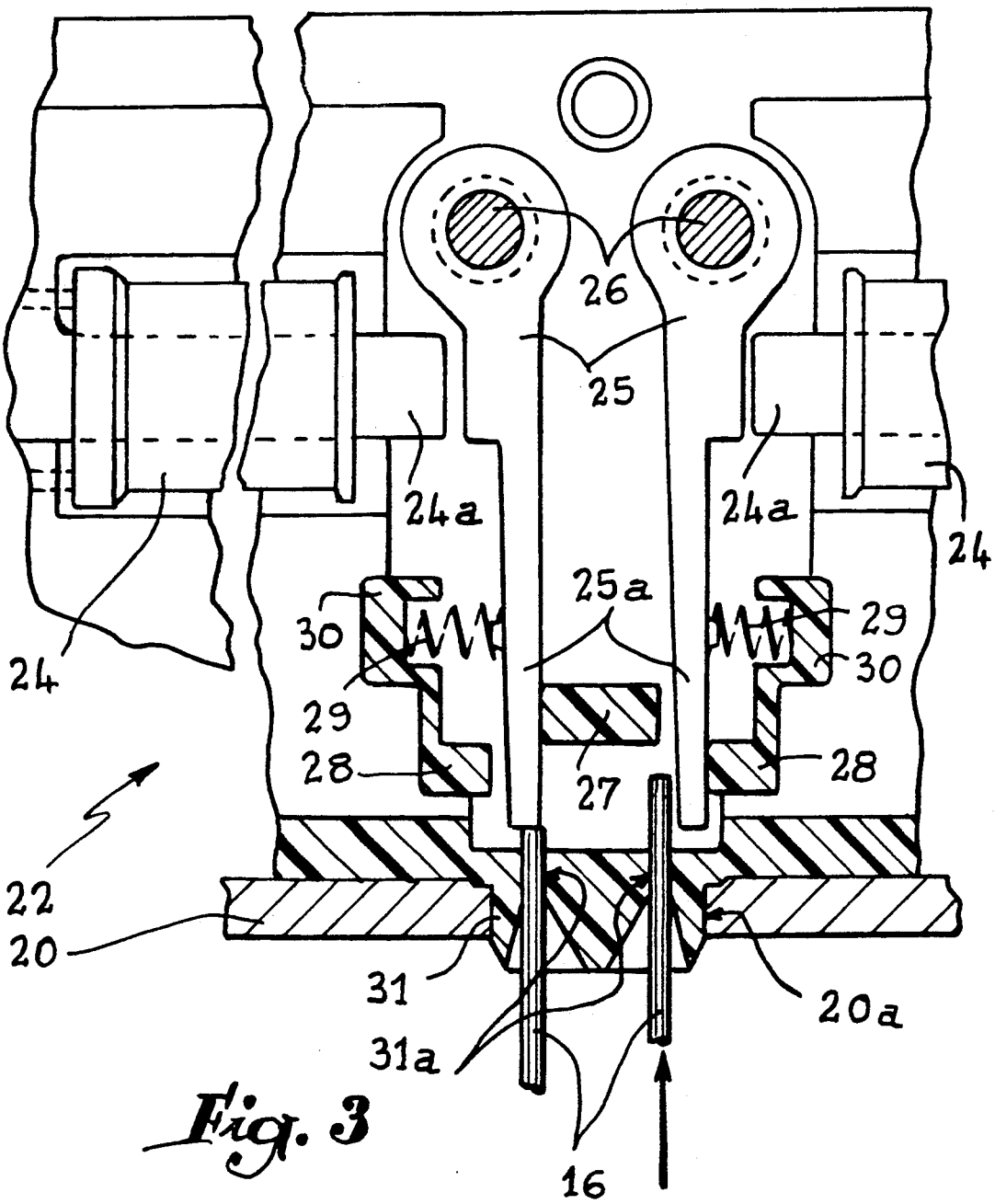
FIG. 3 is a vertical section, on a still larger scale, of one of the cassettes of the unit of FIG. 2.

It will be understood that this spring 29 tends to maintain the blade 25 which is associated therewith with the shank 25*a* applied against the central stop 27, as illustrated in the left-hand side of FIG. 3, consequently defining a first stable position. On the contrary, when the coil 24 is activated by circuit 23, the core 24*a* attracts the blade 25 which tilts angularly, its shank 25*a* thus coming into abutment against the lateral stop 28 which consequently defines a second stable position, as illustrated in the right-hand part of FIG. 3.

The bottom of each cassette 2 comprises a boss 31 which projects outwardly and which is engaged, with a clearance as small as possible, inside an opening made in the bottom of the housing 20, which opening has been referenced 20*a* in FIG. 2. The boss 31 is provided with two parallel holes 31*a* which are calibrated to allow engagement, virtually without lateral clearance, of the needles 16. Each hole 31*a* is positioned so as to be aligned with respect to the shank 25*a* of one of the two blades 25 when the blades are in the rest position in abutment against the central stop 27.

It will be readily appreciated that such a structure ensures a perfectly precise centering of the needles 16 with respect to the actuation blades 25 in either of the two positions described above. Guiding is effected with the aid of four parts mounted with the same piece, namely the three stops 27 and 28 and the boss 31 of each cassette 22. It will be observed that, in addition to its function of positioning of the shank 25*a* with respect to the needle 16 which corresponds thereto, stop 28 prevents any contact between the blade 25 and the core 24*a*, thus limiting wear of the assembly.

The precision obtained is such that the angular displacement of the blades 25 may be maintained at a minimum value, which avoids any phenomenon of inertia capable of affecting functioning of the assembly at high speed. In addition, the assembly of the electro-magnets 24–25 in independent cassettes 22 considerably facilitates the production of control units capable of comprising the desired number of pairs of electro-magnets, as a function of the number of heddle frames 1 to be controlled.

It goes without saying that the invention is applicable to the control of dobbies of the type incorporating double-swinging levers, as well as to any other weaving mechanism. Its application is such as to prove advantageous in the case of non-synchronized dobbies which comprise only one series of electromagnets.

What is claimed is:

1. In an electro-magnetic unit for controlling dobbies and other weaving mechanisms of the type including a plurality of electro-magnetics for controlling the reciprocal movement of needles of a control device, and which control device includes pushers and knives for effecting displacement of actuation levers, and wherein each of the electro-magnets includes a coil provided with a core for attracting a blade which forms a stop for limiting the reciprocal movement of one of the needles, the improvement comprising, a plurality of flat cassettes mounted side-by-side within a box, the electro-magnets being mounted within said cassettes, each of said cassettes including inner stop members for limiting the lateral displacement of a corresponding blade between two stable positions, and at least one calibrated hole through which a needle is reciprocally moved.

2. The unit of claim 1 wherein each box includes an opening therein, each calibrated hole being made in a boss which projects from the cassette and is engaged in said opening in the box.

3. The unit of claim 2 wherein each box includes a housing having opposite edges, a bottom and a cover, each cassette including two lateral lugs which are elastically deformable and gripped between said opposite edges of said housing thereby ensuring the resilient urging of each cassette against said bottom of said box.

4. The unit of claim 1 wherein each box includes a housing having opposite edges, a bottom and a cover, each cassette including two lateral lugs which are elastically deformable and gripped between said opposite edges of said housing thereby ensuring the resilient urging of each cassette against said bottom of said box.

5. In an electro-magnetic unit for controlling dobbies and other weaving mechanisms, of the type including at least a pair of electro-magnets for controlling a pair of reciprocally movable needles of a control device for effecting displacement of actuating levers in a weaving loom and wherein each of the electro-magnets includes a coil provided with a core for attracting a pair of spaced blades which blades function to form stops for limiting the reciprocal movement of the needles, the improvement comprising, at least one cassette in which said electro-magnets are mounted, said at least one cassette including a central stop member and a pair of spaced side stop members, each of said blades being disposed between said central stop members and one of said side stop members so that said blades are movable between two stable positions defined by said central stop member and said side stop members, and a pair of spaced calibrated holes through which said needles are reciprocally moved.

6. The electro-magnetic unit of claim 5 including resilient means mounted between each of said blades and said side stop members.

7. The electro-magnetic unit of claim 6 in which each of said blades includes a shank portion which is selectively attractable toward the core of each electro-magnet, said side stop members being positioned so as to space said shanks of said blades from said cores when said blades are in contact with said side stop members.

* * * * *